US007360274B2

(12) United States Patent
Park et al.

(10) Patent No.: US 7,360,274 B2
(45) Date of Patent: Apr. 22, 2008

(54) VACUUM CLEANER HAVING INTEGRAL FRAME ASSEMBLY AND REMOVABLE MAIN BODY

(75) Inventors: Jung-seon Park, Gwangju (KR); Hyung-il Jeon, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 645 days.

(21) Appl. No.: 10/675,088

(22) Filed: Sep. 30, 2003

(65) Prior Publication Data

US 2004/0261213 A1 Dec. 30, 2004

(30) Foreign Application Priority Data

Jun. 26, 2003 (KR) ..... 10-2003-0042057

(51) Int. Cl.
*A47L 5/30* (2006.01)

(52) U.S. Cl. ..... 15/329; 15/328; 15/331; 15/334

(58) Field of Classification Search ..... 15/328, 15/334, 329, 331, 350, 351, 353
See application file for complete search history.

(56) References Cited

U.S. PATENT DOCUMENTS

| | | | | |
|---|---|---|---|---|
| 5,309,600 | A | 5/1994 | Weaver et al. | |
| 5,524,321 | A | 6/1996 | Weaver et al. | |
| 6,859,975 | B2 * | 3/2005 | Ohta et al. | 15/347 |
| 2004/0216263 | A1 * | 11/2004 | Best et al. | 15/331 |

* cited by examiner

*Primary Examiner*—Shay L Karls
(74) *Attorney, Agent, or Firm*—Ladas & Parry LLP

(57) ABSTRACT

A vacuum cleaner having an integral frame assembly and a detachable main body connected to the frame assembly comprises a nozzle assembly for drawing in an air from a surface to be cleaned, the air containing dust and dirt, a main body, and a frame assembly including a frame body and a connecting portion integrally formed with a lower part of the frame body. The main body includes a body frame, a dust collector connected to the body frame for separating the dust and dirt from the air drawn into the dust collector, and a drive motor for generating a suction force. According to the present invention, the main body of the vacuum cleaner is easily attached to and detached from the frame assembly.

15 Claims, 7 Drawing Sheets

VACUUM CLEANER HAVING INTEGRAL FRAME ASSEMBLY AND REMOVABLE MAIN BODY

BACKGROUND OF THE INVENTION

1. Field of the Invention

The present invention relates generally to a vacuum cleaner, and more specifically to a vacuum cleaner having an integral frame assembly and a main body of the vacuum cleaner which is removably connected to the frame assembly.

2. Description of the Related Art

Conventional vacuum cleaners, especially upright type vacuum cleaners, are used in cleaning a wide area, such a floor and a carpet, by forcibly drawing in an air containing dust and dirt by means of a suction force generated in a main body of the vacuum cleaner.

In conventional vacuum cleaners, the main body of the vacuum cleaner is designed to be integrally formed with a frame assembly of the vacuum cleaner. In another design, the main body of the vacuum cleaner is detachably connected to the frame assembly of the vacuum cleaner.

FIG. 1 is a perspective view illustrating a conventional vacuum cleaner having the main body of the vacuum cleaner integrally formed with the frame assembly (hereinafter, called 'non-detachable vacuum cleaner'). Referring to FIG. 1, the conventional non-detachable vacuum cleaner comprises a nozzle assembly 12 disposed at the lower part of a main body 11 of the vacuum cleaner. The nozzle assembly 12 is moved along a surface to be cleaned, such a floor and a carpet. An inside of the main body 11 of the vacuum cleaner is partitioned into a dust collecting chamber, in which a dust bag is disposed, and a motor driving chamber in which a motor is disposed. The dust collecting chamber is contained by a dust cover 10.

A handle 13 is disposed at an upper part of the main body 11 of the vacuum cleaner 50 provide a location for a user to grip the vacuum cleaner when pushing and pulling the nozzle assembly 12. At one side of the main body 11 of the vacuum cleaner is disposed an on/off switch 15.

In the above structure, when the on/off switch 15 is in an on position, the motor is driven and a strong suction force is generated at the nozzle assembly 12. As a result, the area of the surface to be cleaned is subjected to the suction force, and the air containing dust and dirt on the surface to be cleaned is drawn in to the main body 11 of the vacuum cleaner through the nozzle assembly 12.

The air drawn into the nozzle assembly 12 is directed via the dust bag in the dust collecting chamber and is discharged toward the motor driving chamber 30 through a grill portion (not shown) disposed between the dust collecting chamber and the motor driving chamber 30. At this time, the dust and dirt in the air is collected in the dust bag and the clean air is discharged outside via the motor driving chamber 30 and through a discharge grill 40.

After the cleaning operation has been completed, when a given quantity of dust and dirt fills the dust collecting chamber, the user detaches the dust cover 10 and removes and empties the dust bag, and then reattaches the dust cover 10 for operation.

As described above, when the user cleans a narrow space, the conventional non-detachable upright type vacuum cleaner having the above structure causes inconvenience and requires an additional small-sized cleaner or auxiliary accessory.

Meanwhile, a vacuum cleaner having a detachable main body of the vacuum cleaner is disclosed in U.S. Pat. No. 5,524,321 issued Jun. 11, 1996. FIG. 2 is a partially exploded perspective view showing the vacuum cleaner having a detachable main body of the vacuum cleaner (hereinafter, called 'detachable vacuum cleaner'). Referring to FIG. 2, the detachable vacuum cleaner comprises a for cleaning a surface, the main body 16 of the vacuum cleaner, a tubular assembly 25 extending between the nozzle assembly 12 and an upper housing 14, and being connectable to the main body 16 of the vacuum cleaner.

The main body 16 of the vacuum cleaner further comprises a vacuum generator (not shown) for generating a suction force, and a dust collecting chamber 17. The upper housing 14 is at connected to the tubular assembly 25. The upper housing 14 is detachably connected with the main body 11 of the vacuum cleaner. The nozzle assembly 12 may also be detachably connected with the tubular assembly 25.

The normal operation of the above-described detachable vacuum cleaner is essentially the same as that of the non-detachable vacuum cleaner. As necessary, the user can attach and detach the main body 16 of the vacuum cleaner.

However, the above-described conventional detachable vacuum cleaner has some disadvantages.

First, because the tubular assembly 25 is not integrally formed with the upper housing 14 or with the nozzle assembly 12, the main body 16 of the vacuum cleaner can be accidentally separated from the tubular assembly 25 as the user moves the main body 16 of the vacuum cleaner back and forth or from left to right. Consequently, the user may be involved in an accident while cleaning with the detachable vacuum cleaner. In addition, when connected only to the upper housing 14 or to the nozzle assembly 12, the tubular assembly 25 may be damaged due to the bearing of excessive loads thereon.

Secondly, since the tubular assembly 25 has to be manufactured as a separate part, the manufacturing processes get complicated and the cost of the vacuum cleaner is increased.

Thirdly, since the tubular assembly 25 has a complicated structure to be connected to the upper housing 14 and the nozzle assembly 12, the user cannot easily connect the main body 16 of the vacuum cleaner to the tubular assembly 25.

SUMMARY OF THE INVENTION

The present invention has been devised in view of such problems arising from use of conventional detachable and non-detachable vacuum cleaners, and an object hereof is to provide a vacuum cleaner having an integrally formed frame assembly and a detachable main body of the vacuum cleaner to the frame assembly.

Another object of the present invention is to provide a vacuum cleaner having an improved structure, that is capable of easily attaching to and detaching from the main body of the vacuum cleaner and the frame assembly.

Yet another object of the present invention is to provide a vacuum cleaner which is compact-sized and does not require an additional small-sized vacuum cleaner or accessory to reach tight spaces.

According to the present invention, the vacuum cleaner comprises a nozzle assembly for drawing in an air from a surface to be cleaned, the air containing dust and dirt entrained therein, a main body, and a frame assembly including a frame body and a connecting portion integrally formed with a lower part of the frame body. The main body includes a body frame, a dust collector connected to the body frame for separating the dust and dirt from the air drawn into the dust collector, and a drive motor for generating a suction force. Preferably, the nozzle assembly is connected in a pivoting relationship with the frame assembly.

The frame body may further comprise a front casing forwardly facing with respect to the vacuum cleaner and a rear casing coupled to the front casing with the frame body being shaped and dimensioned to correspond to an outer circumference of the main body.

The frame assembly may further comprise a support for supporting and receiving the main body of the vacuum cleaner, and a connecting guide providing for connecting accessories to the vacuum cleaner.

At least one wheel is disposed at a lower part of the frame body for contacting the surface to be cleaned, the at least one wheel being connected to the frame assembly. The main body of the vacuum cleaner may include a detachable dust collector, and the main body of the vacuum cleaner further comprises a dust receptacle removably connected to the body frame for collecting the separated dust and dirt therein, and a button at an upper part of the body frame.

The frame assembly further comprises a frame handle at an upper part thereof, and a handle a shape and dimensions and a recess at a position corresponding to the button of the main body of the vacuum cleaner.

The button is integrally formed with a connecting projection so that the connecting projection moves together with the movement of the button, and a connecting recess is disposed at the frame body of the frame assembly and being shaped and dimensioned to correspond to the connecting projection. Therefore, the main body of the vacuum cleaner is detachably connected to the frame assembly.

A part of the connecting recess may be slanted to provide easy connection to the main body of the vacuum cleaner.

The connecting portion of the frame assembly comprises a communicating hole through which the air drawn in through the nozzle assembly is directed to the main body of the vacuum cleaner, and a communicating member connected to the communicating hole is formed at the main body of the vacuum cleaner. At one side of the connecting portion, a power port is disposed for providing power from the main body of the vacuum cleaner. At a lower part of the main body of the vacuum cleaner, a power connector is formed to be coupled with and connected to the power port.

The connecting portion further comprises at least a first guiding member, and at least a second guiding member, shaped and dimensioned to correspond to the first guiding member, is formed at the lower part of the main body of the vacuum cleaner providing a connection between the main body of the vacuum cleaner and the frame assembly.

The first guiding member may be shaped and dimensioned as a convex protrusion and the second guiding member is shaped and dimensioned as a concave groove, or vice versa.

At the connecting portion, a seating guide is formed corresponding to the lower part of the main body of the vacuum cleaner. The seating guide may be shaped and dimensioned as a convex protrusion, and the lower part of the main body of the vacuum cleaner may be shaped and dimensioned as a concave groove, corresponding to the shape of the seating guide, or vice versa.

The connecting portion may include a shaft member extended therefrom for pivotably connecting the nozzle assembly to the connecting portion. At a front part of the main body of the vacuum cleaner, an on/off switch is formed.

A first fixing portion is formed at the upper part of the nozzle assembly, and a second fixing portion is formed at the lower part of the frame assembly, corresponding to the first fixing portion, for providing the connection between the connecting portion and the frame assembly.

The first fixing portion may be shaped and dimensioned as a concave groove and the second fixing portion may be shaped and dimensioned as a convex protrusion, or vice versa

BRIEF DESCRIPTION OF THE DRAWINGS

The above objects, and other features and advantages of the present invention, will become more apparent after reaching an understanding of the following detailed description when taken in conjunction with the drawings, in which.

DETAILED DESCRIPTION OF THE PREFERRED EMBODIMENTS

A preferred embodiment of the present invention is described with reference to the accompanying drawings.

Figure 3:
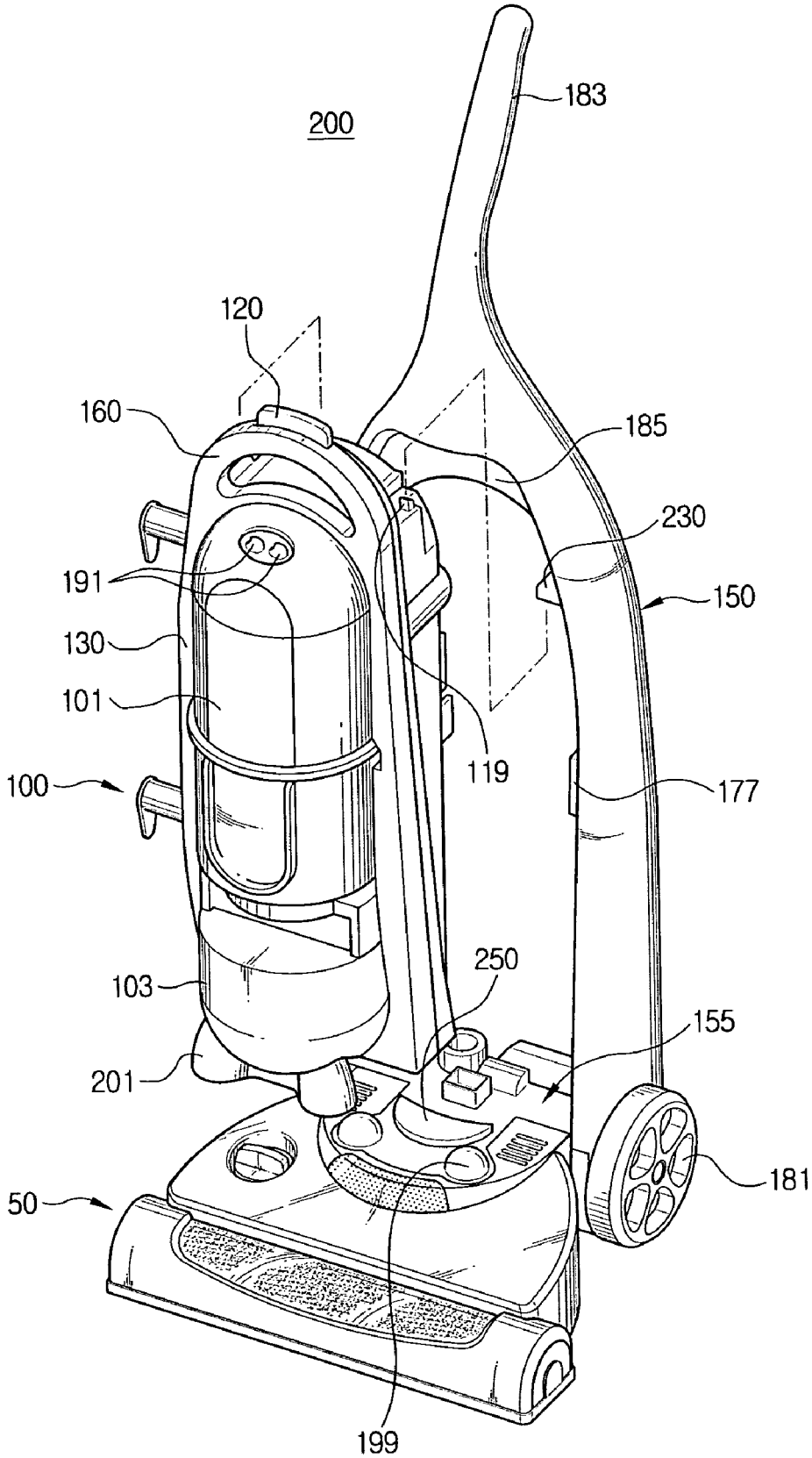
FIG. 3 is a perspective partially exploded view illustrating the structure of a main body of a vacuum cleaner and a frame assembly according to the present invention.

FIG. 3 is a perspective, partially exploded view illustrating the structure of a main body of a vacuum cleaner and a frame assembly according to the present invention. As shown in FIG. 3, the vacuum cleaner 200, having an integral frame assembly 150 and a detachable main body 100 of the vacuum cleaner 200 comprising a nozzle assembly 50 for drawing in air containing dust and dirt from a surface to be cleaned, the main body 100 of the vacuum cleaner 200 being in fluid communication with the nozzle assembly 50, and the frame assembly 150 being pivotably connected to the nozzle assembly 50.

The main body 100 of the vacuum cleaner 200 comprises a body frame 130, a dust collector 101 connected to the body frame 130, for centrifugally separating the dust and dirt from the air drawn thereinto, a dust receptacle 103 detachably connected to the body frame 130 and in fluid communication with the dust collector 101 for collecting the separated dust and dirt therein, and a tab or button 120 disposed at an upper part of the upright body frame 130.

Preferably, the dust collector 101 employs a general or known cyclone-type dust collecting apparatus for centrifugally separating the dust and dirt from the air.

The tab or button 120 is integrally formed with one or more connecting projections 119 disposed in a handle portion 160 of the main body 100, so that a connecting projection 119 elastically moves upward and downward according to the movement of the button 120.

The frame assembly 150 comprises a frame connecting portion 230 having a connecting recess 171 (FIG. 6) corresponding to the connecting projection 119. According to the position of the button 120 providing for connection and disconnection of the connecting projection 119 and the connecting recess 171 in the frame connecting portion 230, the main body 100 of the vacuum cleaner 200 is attached to and detached from the frame assembly 150 (see detail view of FIG. 6).

Figure 6:
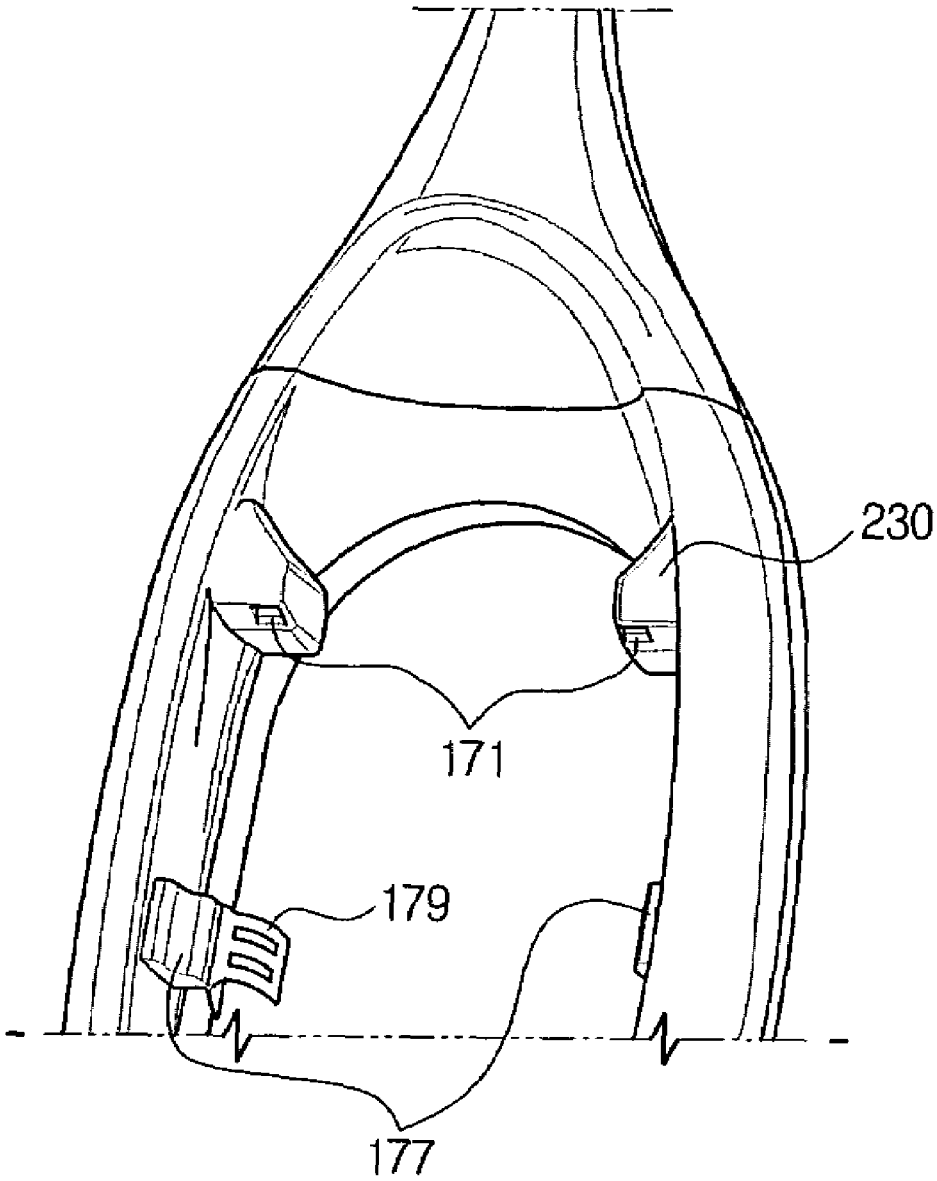
FIG. 6 is perspective detail view illustrating connecting projections of the frame assembly according to the present invention.

A part of the connecting projection 171 is formed to be slanted so that the main body 100 of the vacuum cleaner 200 is guided by the slant and is easily connected to the frame assembly 150 (see FIG. 6).

At a front part of the main body 100 of the vacuum cleaner 200 (FIG. 3), an on/off switch 191 is formed in front of the main body 100 of the vacuum cleaner 200 so that a user can easily direct power to the vacuum cleaner 200.

Figure 4:
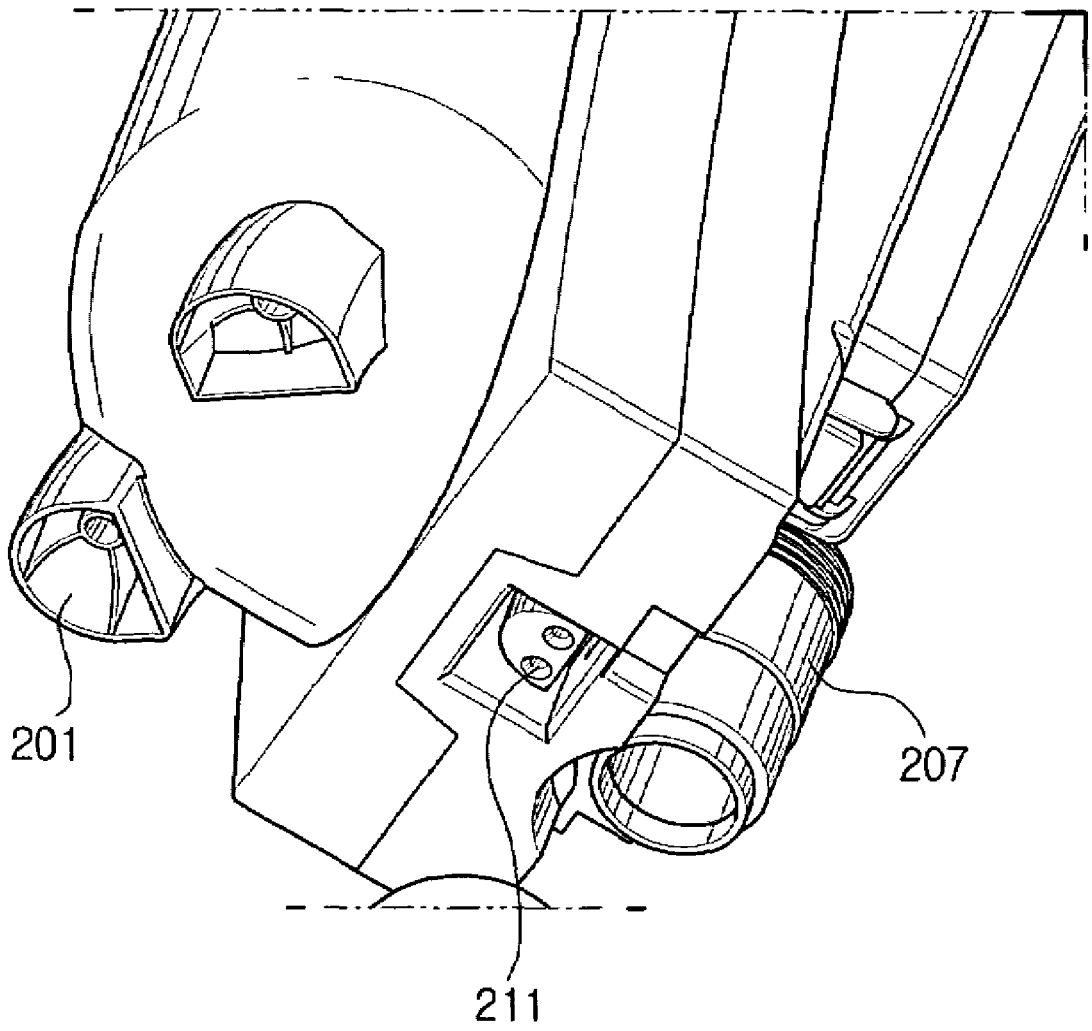
FIG. 4 is a bottom detail view illustrating the vacuum cleaner according to the present invention.
Figure 5:
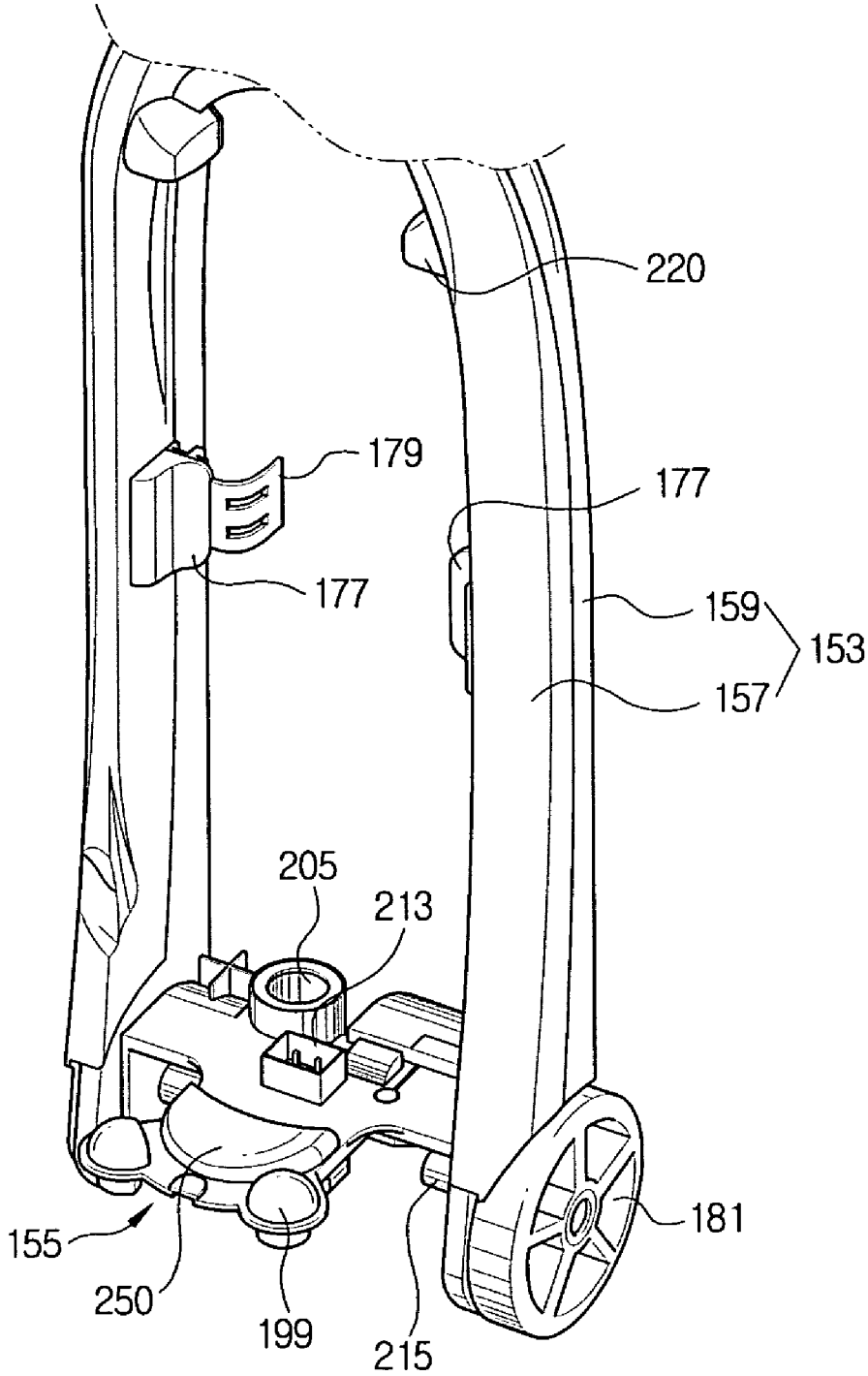
FIG. 5 is a perspective detail view illustrating the frame assembly of the vacuum cleaner according to the present invention.

Hereinafter, with reference to FIGS. 3 through 5, the frame assembly 150 detachably connected to the main body 100 of the vacuum cleaner 200 is described. FIG. 4 is a bottom detail view of the vacuum cleaner 200 according to the present invention. FIG. 5 is a perspective detail view of the frame assembly 150 of the vacuum cleaner 200 according to the present invention. As shown in FIGS. 3 and 5, the frame assembly 150 comprises a frame body 153, and a connecting portion 155 integrally formed at the frame body 153. The frame assembly 150 is pivotably connected with the nozzle assembly 50.

The frame body 153 comprises a front casing 157 facing forward with respect to the vacuum cleaner 200 and a rear casing 159 coupled to the front casing 157. The frame body 153 generally corresponds in shape to the outer circumference of the main body 100 of the vacuum cleaner 200 so as to easily receive the main body 100 of the vacuum cleaner 200 in the frame assembly 150, when the two are connected.

The frame assembly 150 further comprises a retaining support 177 for supporting the main body 100 of the vacuum cleaner 200. At one side of the support 177, a connecting guide 179 is formed for connection of accessories used with the vacuum cleaner 200. The accessories (not shown) generally may include a brush or a bedclothes brush. The accessories are connected to the connecting guide 179 so that the size of the main body 100 remains compact and the load of the main body 100 is reduced when the main body 100 of the vacuum cleaner 200 is separated from the frame 150.

Referring again to FIG. 3, at least one wheel 181 is disposed adjacent both sides of a lower part of the of the frame assembly 150 and is moved over the surface to be cleaned. A frame handle 183 is disposed at an upper part of the frame assembly 150 providing for easy manipulation of the vacuum cleaner 200 by the user when the main body 100 of the vacuum cleaner 200 is connected to the frame assembly 150.

Figure 1:
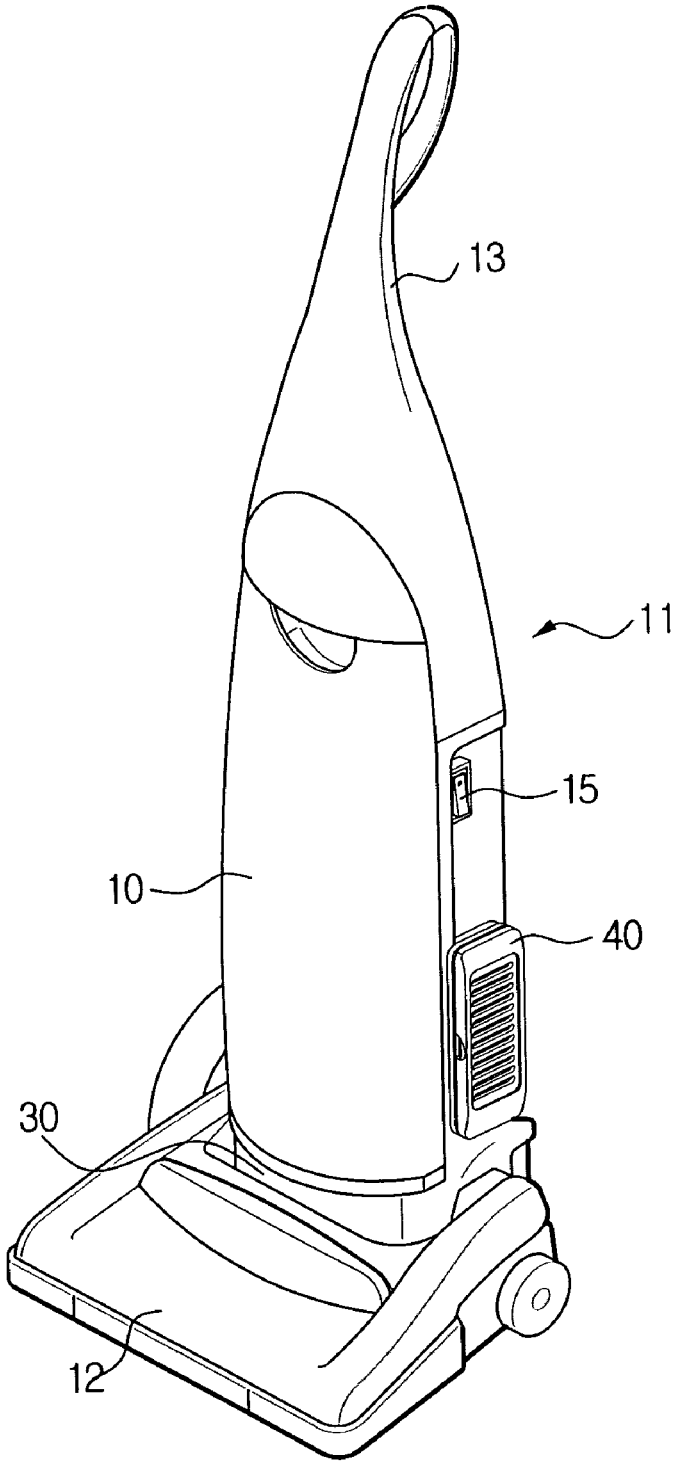
FIG. 1 (PRIOR ART)
FIG. 1 is a perspective view illustrating the structure of a conventional vacuum cleaner having a non-detachable main body.
Figure 2:
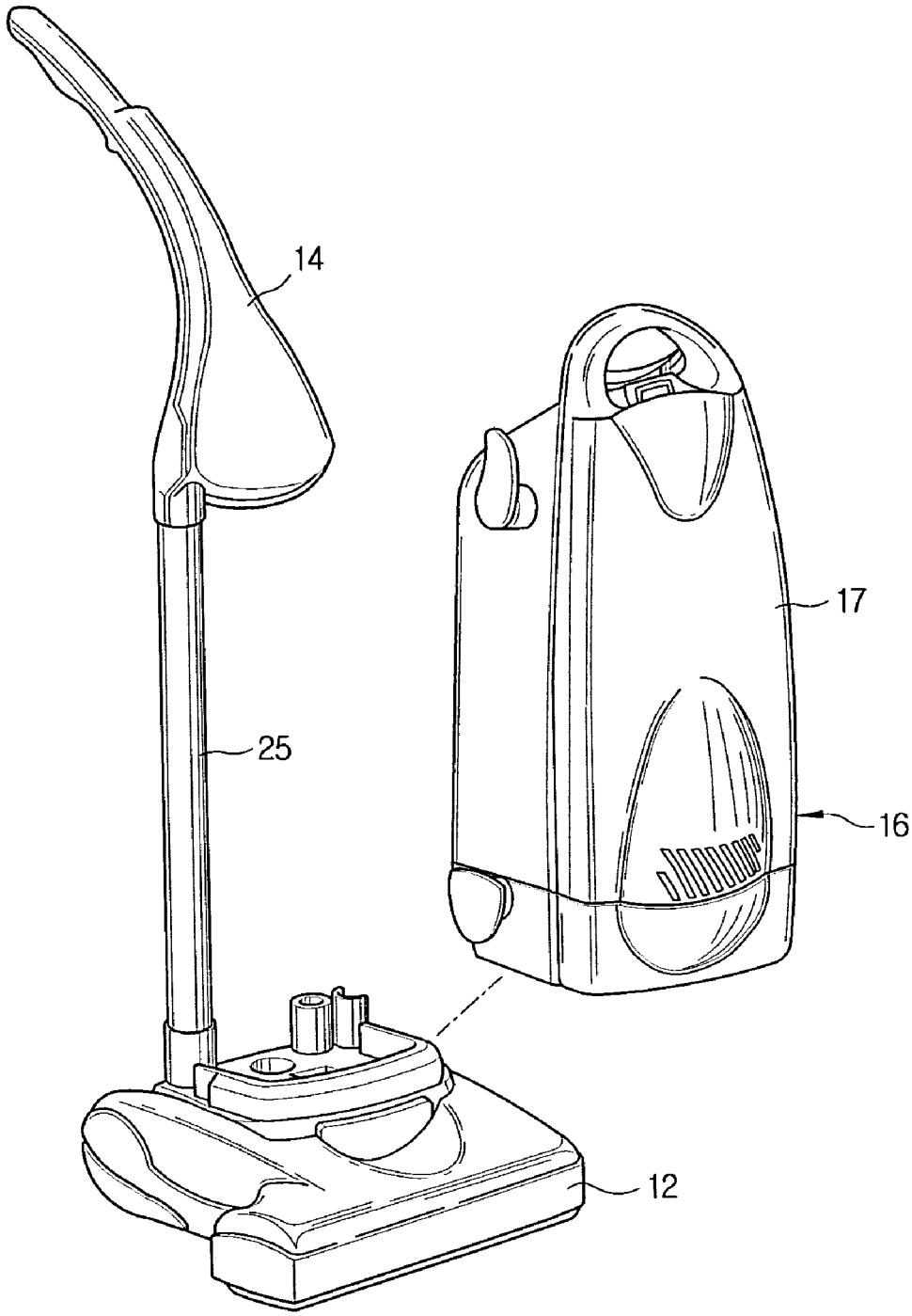
FIG. 2 (PRIOR ART)
FIG. 2 is a perspective partially exploded view illustrating a structure of a conventional vacuum cleaner having a detachable main body.

A handle groove or depression 185 is formed at the frame assembly 150 in a position corresponding to the button 120 of the main body 100 of the vacuum cleaner 200. In order to detach the main body 100 of the vacuum cleaner 200 from the frame assembly 150, the user depresses the button 120, which is exposed through the handle groove 185. Accordingly, the operations of pushing the button 120 and detaching the main body 100 of the vacuum cleaner 200 are conducted simultaneously, and therefore, the detaching operation become much easier and more convenient than the detachable vacuum cleaner of FIG. 2.

At the connecting portion 155 of the frame assembly 150, a communicating hole 205 (FIG. 5) is formed for the contaminant-laden air drawn in through the nozzle assembly 50 to flow to the main body 100 of the vacuum cleaner 200. A communicating member 207 (FIG. 4) is formed at the main body 100 of the vacuum cleaner 200 for connection with the communicating hole 205.

At one side of the connecting portion 155, a power port 213 (FIG. 5) is formed for supplying electrical power to the main body 100 of the vacuum cleaner 200. At a lower part of the main body 100 of the vacuum cleaner 200, a power connector 211 (FIG. 4) is formed to be connected to the power port 213.

The connecting portion 155 includes at least a first guiding member 199 (FIG. 5), and the main body 100 of the vacuum cleaner 200 includes at least a second guiding member 201 (FIG. 4) at the lower part thereof, corresponding to the first guiding member 199. By connection of the first and the second guiding members 199, 201, the main body 100 of the vacuum cleaner 200 becomes attached to the frame assembly 150. Preferably, plural sets of first and second guiding members 199, 201 may be provided, for example, two or more than two.

In addition, the first guiding member 199 may be shaped and dimensioned as a convex protrusion, and the second guiding member 201 shaped and dimensioned as a concave groove, as shown, or vice versa.

A seating guide 250 is formed at the connecting portion 155, corresponding to the low part of the main body 100 of the vacuum cleaner 200. The seating guide 250 may be a convex protrusion and the lower part of the main body 100 of the vacuum cleaner 200 may be a corresponding concave groove, or vice versa.

Also, a shaft member 215 is extended from the lower part of the connecting portion 155 for pivotably connecting with the nozzle assembly 50.

Figure 7:
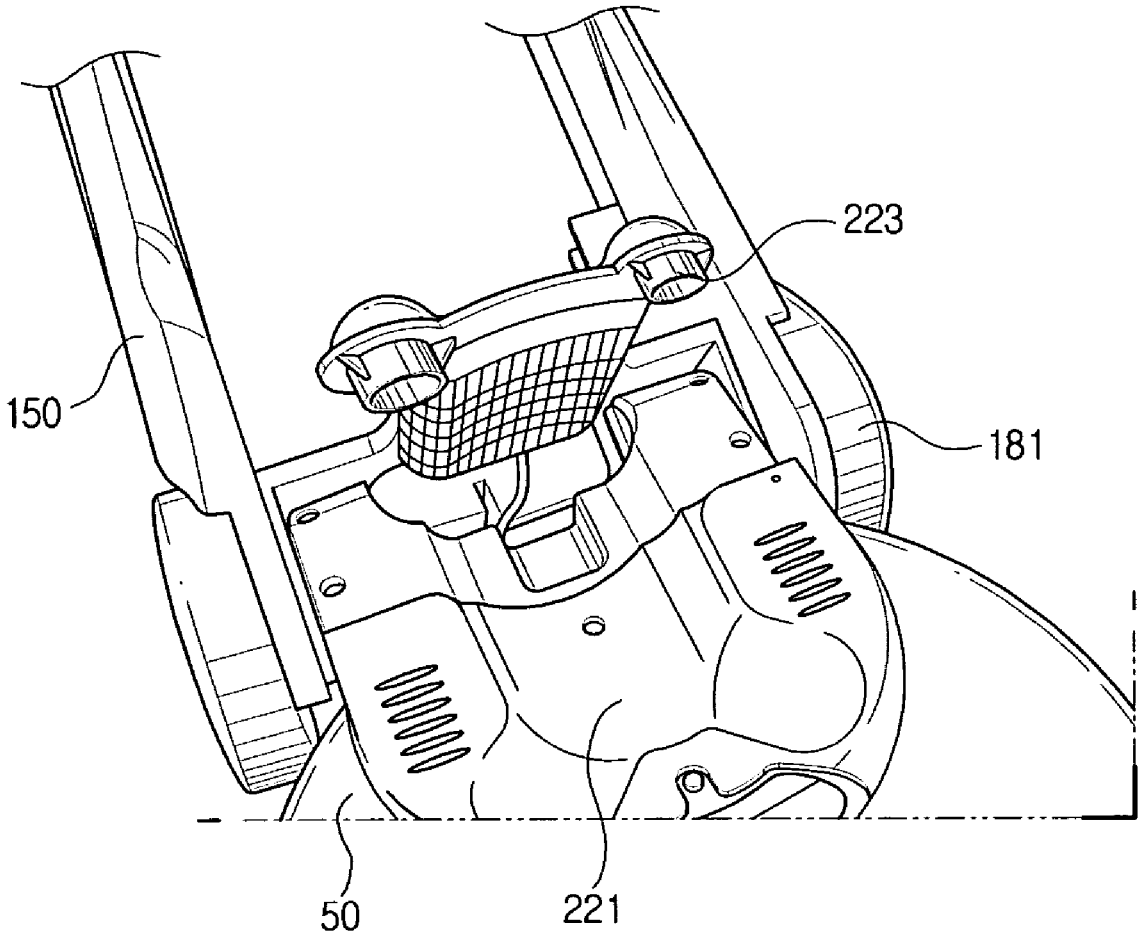
FIG. 7 is a perspective detail view illustrating the frame assembly and a nozzle assembly shown at a predetermined angle.

Referring now to FIG. 7, the nozzle assembly 50 is described in greater detail. FIG. 7 is a perspective detail view of the frame assembly 150 and the nozzle assembly 50 positioned at a predetermined angle relative to each other according to the present invention. As shown in FIG. 7, a first fixing portion 221 is formed at an upper side of the nozzle assembly 50, and a second fixing portion 223 is formed at a bottom side of the connecting portion 155 of the frame assembly 150, corresponding to the first fixing portion 221. By coupling the first fixing portion 221 with the second fixing portion 223, the connecting portion 155 and the nozzle assembly 50 are connected.

The first fixing portion 221 may be a convex protrusion and the second fixing portion 223 may be a concave groove, or vice versa. By means of the first and the second fixing portions 221, 223, the frame assembly 150 and the nozzle assembly 50 are pivotably connected with each other, and therefore, the user can conveniently manipulate the vacuum cleaner 200 and the handle 183 at a desired angle with respect to the surface to be cleaned.

Hereinafter, the operation of the vacuum cleaner 200 with the integral frame assembly 150 and the main body 100 of the vacuum cleaner 200 detachable to the frame assembly 150 is described in greater detail.

When the on/off switch 191 is in on position and the power is supplied, a drive motor (not shown) in the main body 100 of the vacuum cleaner 200 is driven and a strong suction force is generated at the nozzle assembly 50 which is in fluid communication with the main body 100 of the vacuum cleaner 200. By the suction force, the dust and dirt on the surface to be cleaned is drawn into the main body 100 of the vacuum cleaner 200 within which the air the dirt and dust is entrained through an inlet (not shown) on the bottom side of the nozzle assembly 50.

The drawn air is directed to the dust collector 101 in the main body 100 of the vacuum cleaner 200 and the dust and dirt is centrifugally separated from the air. The clean air is discharged through a discharge grill (not shown) formed at a rear side of the main body 100 of the vacuum cleaner 200.

The separated dust and dirt is collected in the dust receptacle 103 of the main body 100 of the vacuum cleaner 200. When the collected dust and dirt reaches a predetermined quantity, the user removes the dust and dirt by detaching the dust receptacle 103. Then the dust receptacle 103 is re-attached and the cleaning operation can be performed again.

When cleaning a narrow space or a doorsill, the user pushes the button 120 at the handle portion 160 of the main body 100 of the vacuum cleaner 200, and accordingly, the connecting projection 119, integrally formed with the button 120, is released from the connecting recess 171 of the frame assembly 150.

After cleaning the intended area using the detached main body 100 of the vacuum cleaner 200 alone, in order to attach the main body 100 of the vacuum cleaner 200 to the frame assembly 150, the user securely connects the main body 100 of the vacuum cleaner 200 with the frame assembly 150, the first guiding member 199, the seating guide 250 corresponding to the lower part of the main body 100 of the vacuum cleaner 200, the support 177 at the frame assembly 150, and the connecting portion 155 integrally formed at the lower part of the frame assembly 150. Accordingly, when the user manipulates the vacuum cleaner 200 right and left, the main body 100 of the vacuum cleaner 200 is not released from the frame assembly 150.

Also, the dead weight of the vacuum cleaner 200 enables the easy attachment of the main body 100 of the vacuum cleaner 200 to the frame assembly 150 in aligning the first guiding member 199 with the second guiding member 201 and then pushing the main body 100 of the vacuum cleaner 200 into engagement with the frame assembly 150.

According to the present invention as aforementioned, the user can use the vacuum cleaner 200 safely, since the main body 100 of the vacuum cleaner 200 is firmly attached to the frame assembly 150, which is integrally formed with the connecting portion 155 in a solid structure. Also, the user does not need to purchase an additional small-sized cleaner, since the user can utilize the main body 100 of the vacuum cleaner 200 alone for tight spaces as the occasion demands.

In addition, the vacuum cleaner 200 is structured solidly so that the main body 100 of the vacuum cleaner 200 is easily attached to the frame assembly 150 only by the self-weight. Therefore, the user conveniently attaches and detaches the main body 100 of the vacuum cleaner 200.

Also, the frame assembly 150 is integrally formed with the connecting portion 155, and hence the parts of the vacuum cleaner 200 and the assembly processes are reduced, and the productivity is enhanced.

While the preferred embodiment of the present invention has been described, additional variations and modifications in that embodiment may occur to those skilled in the art once they learn of the basic inventive concepts. Therefore, it is intended that the appended claims shall be construed to include both the preferred embodiment and all such variations and modifications as fall within the spirit and scope of the invention.

What is claimed is:

1. A vacuum cleaner comprising:

a nozzle assembly for drawing in an air from a surface to be cleaned, the air having dust and dirt entrained therein;

a main body including a body frame, a dust collector connected to the body frame for separating the dust and dirt from the air drawn into the dust collector, and a drive motor for generating a suction force; and a frame assembly, comprising a front casing facing forward with respect to the vacuum cleaner and a rear casing coupled to the front casing, the frame body being shaped and configured to correspond to an outer circumference of the main body and further including a frame body and a connecting portion integrally formed with a lower part of the frame body, the connecting portion of the frame assembly being further comprised of first and second convex and substantially hemispherical guiding members protruding upwardly from the connecting portion, and a convex seating guide that protrudes upwardly from the connecting portion, the first and second convex and substantially hemispherical guiding members and the convex seating guide on the connecting portion being received into corresponding mating receptacles on the main body, the frame assembly connected with the nozzle assembly in pivoting relationship.

2. The vacuum cleaner of claim 1, wherein the frame assembly further comprises a support for supporting the main body of the vacuum cleaner in a mounting position.

3. The vacuum cleaner of claim 1, wherein the frame assembly further comprises a connecting guide for removably connecting accessories to the vacuum cleaner.

4. The vacuum cleaner of claim 1, wherein the frame body further comprises at least one wheel connected to a lower part of the frame assembly for contacting the surface to be cleaned.

5. The vacuum cleaner of claim 1, wherein the main body of the vacuum cleaner is connected to the dust collector, and further comprises a dust receptacle removably connected to the body frame for collecting the dust and dirt therein and a button formed at an upper part of the body frame.

6. The vacuum cleaner of claim 5, wherein the frame assembly further comprises a frame handle disposed at an upper part thereof, and a handle groove disposed at a position corresponding to the button of the main body of the vacuum cleaner.

7. The vacuum cleaner of claim 6, wherein the button at the main body of the vacuum cleaner is integrally formed with a connecting projection so that the connecting projection is moves together with the movement of the button, and a connecting recess is disposed in the frame body of the frame assembly and being shaped and dimensioned to correspond to the connecting projection so that the main body of the vacuum cleaner is detachably connected to the frame assembly.

8. The vacuum cleaner of claim 7, wherein at least part of the connecting recess is slanted to provide easy connection to the main body of the vacuum cleaner.

9. The vacuum cleaner of claim 1, wherein the connecting portion of the frame assembly comprises a communicating hole through which the air drawn in through the nozzle assembly is directed to the main body of the vacuum cleaner, and a communicating member connected to the communicating hole is formed at the main body of the vacuum cleaner.

10. The vacuum cleaner of claim 1, wherein a power port is disposed at one side of the connecting portion for providing power from the main body of the vacuum cleaner, and power connector is disposed at a lower part of the main body of the vacuum cleaner to be connected to the power port.

11. The vacuum cleaner of claim 1, wherein the convex seating guide is shaped and dimensioned as a convex protrusion, and the lower part of the main body of the vacuum cleaner is shaped and dimensioned as a concave groove corresponding to the shape of the seating guide.

12. The vacuum cleaner of claim 1, wherein the connecting portion includes a shaft member extended downwardly therefrom for pivotably connecting the shaft member with the nozzle assembly.

13. The vacuum cleaner of claim 1, wherein an on/off switch is disposed at a front part of the main body of the vacuum cleaner.

14. The vacuum cleaner of claim 1, wherein a first fixing portion is formed at the upper part of the nozzle assembly, and a second fixing portion is formed at the lower part of the frame assembly, corresponding to the first fixing portion, to provide a connection between the connecting portion and the frame assembly.

15. The vacuum cleaner of claim 14, wherein the first fixing portion is shaped and dimensioned as a concave groove, and the second fixing portion is shaped and dimensioned as a convex protrusion.

* * * * *